US009393173B1

(12) United States Patent
Meza

(10) Patent No.: US 9,393,173 B1
(45) Date of Patent: Jul. 19, 2016

(54) REHABILITATION AND WALKING ASSISTING ASSEMBLY

(71) Applicant: Javier Meza, Los Angeles, CA (US)

(72) Inventor: Javier Meza, Los Angeles, CA (US)

( * ) Notice: Subject to any disclaimer, the term of this patent is extended or adjusted under 35 U.S.C. 154(b) by 0 days.

(21) Appl. No.: 14/645,719

(22) Filed: Mar. 12, 2015

(51) Int. Cl.
*A63B 21/00* (2006.01)
*A61H 3/04* (2006.01)
*A61H 3/00* (2006.01)
*A63B 21/055* (2006.01)

(52) U.S. Cl.
CPC ..... *A61H 3/04* (2013.01); *A61H 3/008* (2013.01); *A63B 21/055* (2013.01)

(58) Field of Classification Search
USPC ..... 482/1–148; 135/67; 602/26; 297/5–6; 623/26
See application file for complete search history.

(56) References Cited

U.S. PATENT DOCUMENTS 572,613 A 12/1896 Packard
2,111,018 A * 3/1938 Ahler ..... A61F 5/0102 602/16
2,719,568 A 10/1955 Webb
3,258,220 A * 6/1966 Munger ..... B65H 75/406 242/404.1
3,986,502 A * 10/1976 Gilson ..... A61H 3/00 135/68
4,826,151 A * 5/1989 Nuredin ..... A63B 21/0004 297/423.38
4,872,665 A * 10/1989 Chareire ..... A61H 1/0237 482/51
4,941,497 A 7/1990 Prather et al.
5,058,912 A * 10/1991 Harroun ..... A61H 3/04 135/67
5,152,730 A * 10/1992 Hoffman ..... A61H 3/008 135/67
5,275,426 A 1/1994 Tankersley
D375,770 S 11/1996 Sicard
5,800,318 A * 9/1998 Coviello ..... A61H 3/04 135/67
6,578,594 B1 6/2003 Bowen et al.
6,675,820 B2 * 1/2004 Balan ..... A61H 3/008 135/67
7,001,313 B1 * 2/2006 Crnkovich ..... A61H 3/04 135/67
7,510,214 B1 * 3/2009 Oxford ..... A63B 22/14 280/827
7,568,712 B2 * 8/2009 Kovachi ..... A61H 3/008 280/23.1
7,735,499 B1 6/2010 Pennise
8,020,815 B2 * 9/2011 Cox ..... F16M 11/02 248/121
8,961,186 B2 * 2/2015 LoSasso ..... A63B 71/0622 434/255
9,149,408 B2 * 10/2015 Karlovich ..... A63B 69/0064
9,265,686 B1 * 2/2016 Pichnarcik ..... A61H 3/00
2014/0026893 A1 * 1/2014 Johnson ..... A61H 3/008 128/845
2015/0297439 A1 * 10/2015 Karlovich ..... A63B 22/02 280/650
2015/0335940 A1 * 11/2015 Johnson ..... A63B 21/1488 248/118

* cited by examiner

*Primary Examiner* — Stephen Crow

(57) ABSTRACT

A rehabilitation and walking assisting assembly includes a pair of plates each having an upper edge, a lower edge, a first lateral ledge and a second lateral edge. The plates have an inner surface and an outer surface. A plurality of straps is attached to and extends between the pair of plates. A plurality of legs defines a first set of legs and a second set of legs. The first set of the legs is attached to the outer surface of one of the plates and the second set of legs is attached to the outer surface of the other one of the plates. Each of the legs includes a lower end terminating with a wheel. The plates are positionable on opposite sides of a torso of a person such that the legs assist the person while walking.

7 Claims, 4 Drawing Sheets

REHABILITATION AND WALKING ASSISTING ASSEMBLY

BACKGROUND OF THE DISCLOSURE

Field of the Disclosure

The disclosure relates to walking aid devices and more particularly pertains to a new walking aid device for assisting a person to walk.

SUMMARY OF THE DISCLOSURE

An embodiment of the disclosure meets the needs presented above by generally comprising a pair of plates each having an upper edge, a lower edge, a first lateral ledge and a second lateral edge. The plates have an inner surface and an outer surface relative to each other such that the inner surfaces face each other. A plurality of straps is attached to and extends between the pair of plates. A plurality of legs defines a first set of legs and a second set of legs. The first set of the legs is attached to the outer surface of one of the plates and the second set of legs is attached to the outer surface of the other one of the plates. Each of the legs includes an upper end and a lower end and each of the lower ends terminates with a rotatable and swiveling wheel. The plates are configured to be positioned on opposite sides of a torso of a person such that the legs assist the person while walking.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
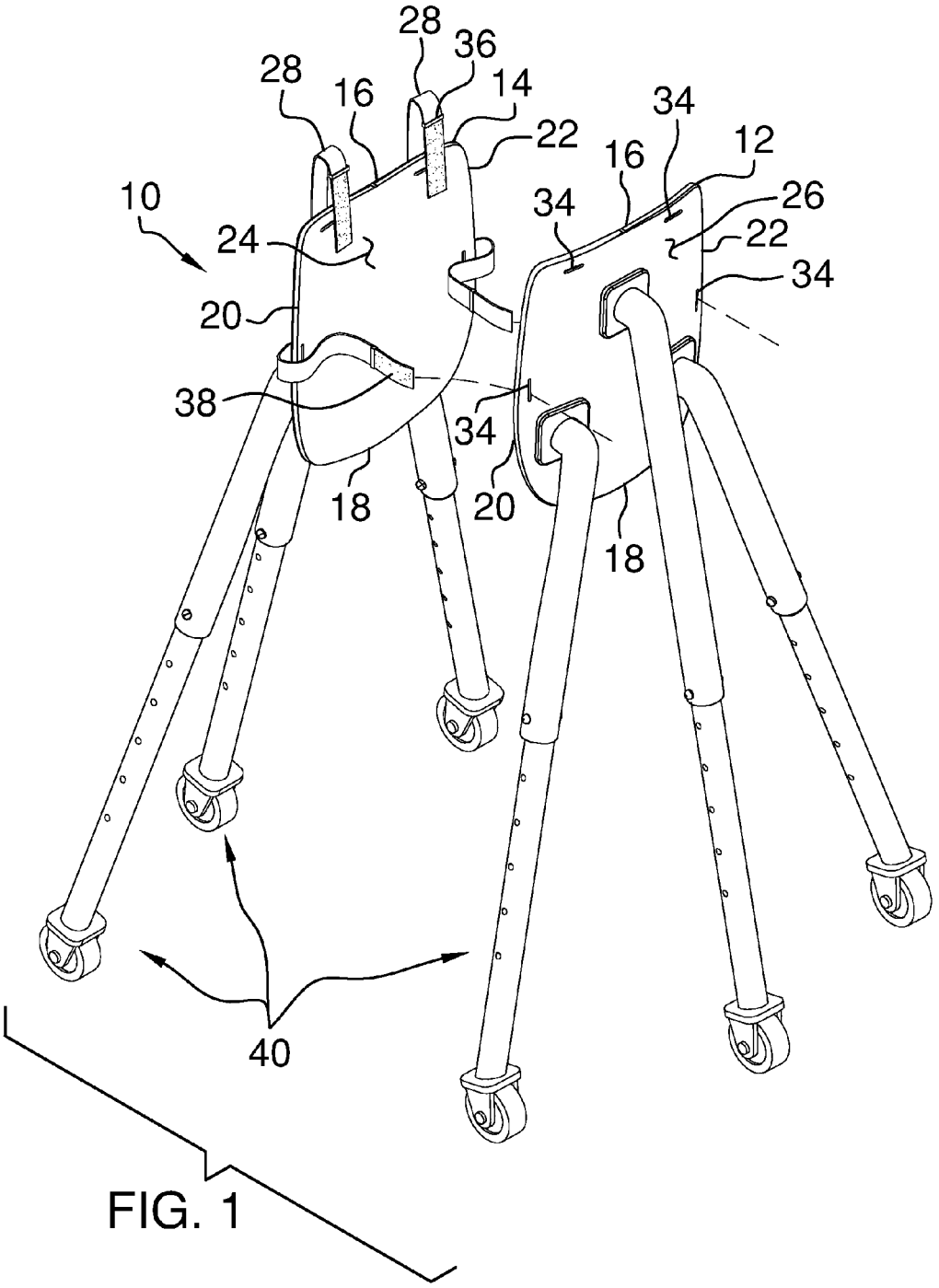
FIG. 1 is a top perspective view of a rehabilitation and walking assisting assembly according to an embodiment of the disclosure.
Figure 2:
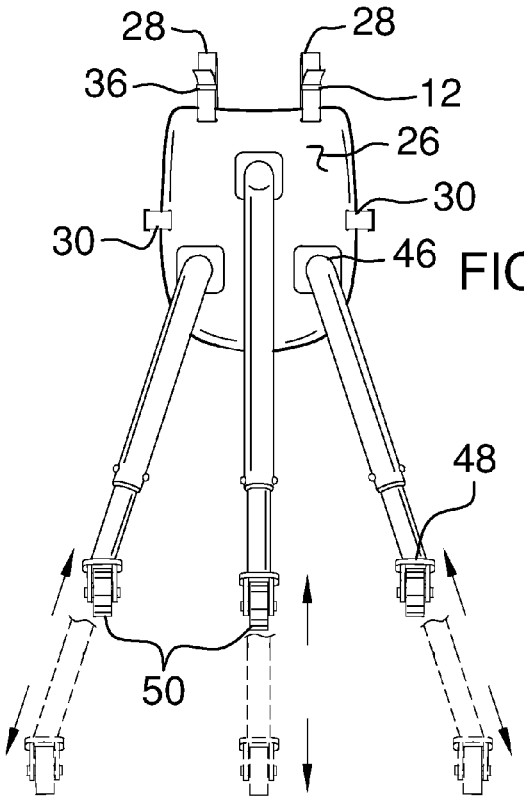
FIG. 2 is a front view of an embodiment of the disclosure.
Figure 3:
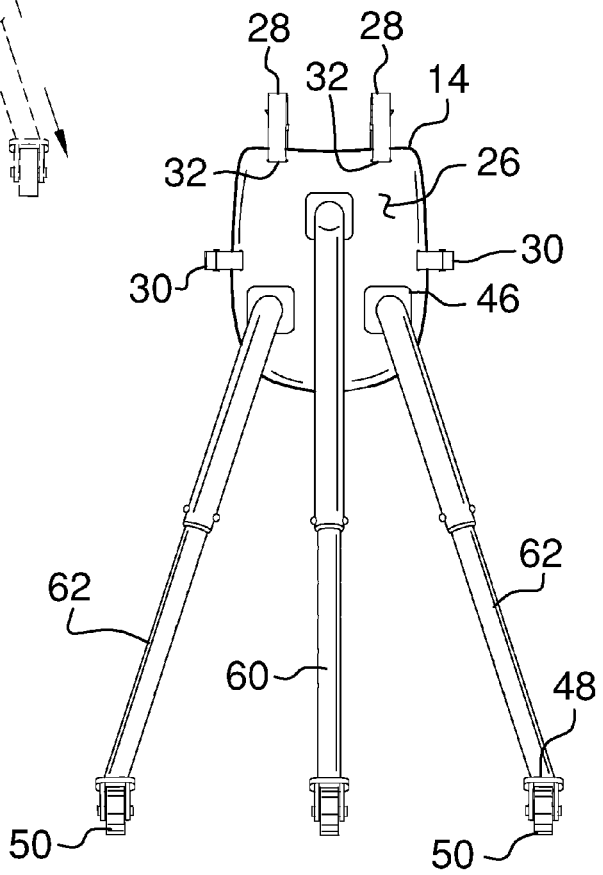
FIG. 3 is a rear view of an embodiment of the disclosure.
Figure 4:
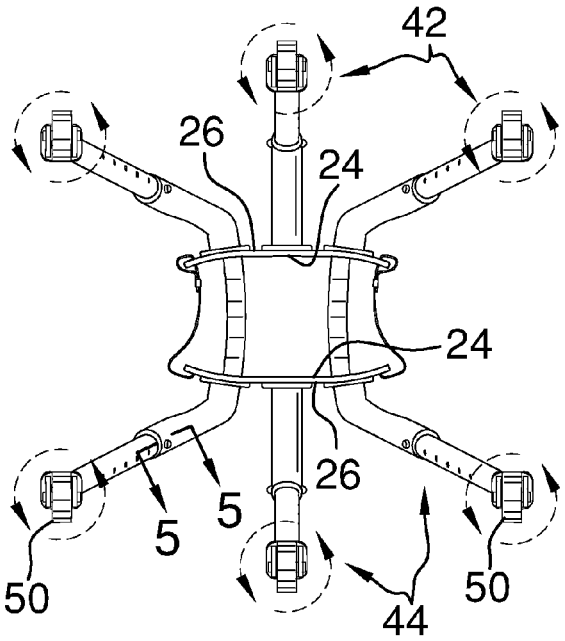
FIG. 4 is a bottom view of an embodiment of the disclosure.
Figure 5:
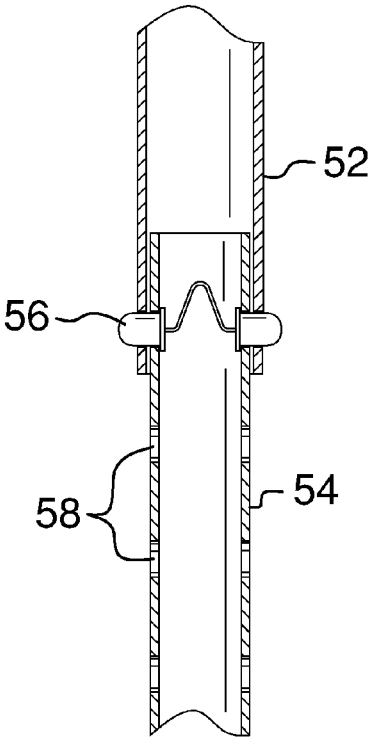
FIG. 5 is a cross-sectional view of an embodiment of the disclosure taken along line 5-5 of FIG. 4.

With reference now to the drawings, and in particular to FIGS. 1 through 6 thereof, a new walking aid device embodying the principles and concepts of an embodiment of the disclosure and generally designated by the reference numeral 10 will be described.

As best illustrated in FIGS. 1 through 6, the rehabilitation and walking assisting assembly 10 generally comprises a pair of plates 12, 14 each having an upper edge 16, a lower edge 18, a first lateral ledge 20 and a second lateral edge 22. The plates 12, 14 have an inner surface 24 and an outer surface 26 relative to each other such that the inner surfaces 24 face each other. Each of the inner surfaces 24 is concavely arcuate from the first lateral edge 20 to the second lateral edge 22. The plates 12, 14 are comprised of a rigid material such as a plastic or other composite material.

A plurality of straps 28, 30 is attached to and extends between the pair of plates 12, 14. The plurality of straps 28, 30 includes a pair of upper straps 28 extending between associated ones of the upper edges 16. The plurality of straps 28 includes a pair of lateral straps 30 wherein one of the lateral straps 30 extends between aligned ones of the first lateral edges 20 and one of the lateral straps 30 extends between aligned ones of the second lateral edges 22. The straps 28, 30 may each include a fixed end 32 attached to a second plate 14 of the pair of plates that are extendable through apertures 34 in a first plate 12 of the pair of plates. Couplers 36 are provided to secure the straps 28, 30 to themselves and may comprise loops through which the straps 28, 30 are extended as they are folded over themselves. The straps 28, 30 may further include hook and loop connectors 38 to further secure the straps 28, 30 to themselves so that they do not easily slip apart.

A plurality of legs 40 is provide and defines a first set of legs 42 and a second set 44 of legs. The first set of the legs 42 is attached to the outer surface 26 of one of the plates 12, 14 and the second set of legs 44 is attached to the outer surface 26 of the other one of the plates 12, 14. Each of the legs 44 includes an upper end 46 and a lower end 48 and each of the lower ends 48 terminates with a rotatable and swiveling wheel 50. It should be understood that the wheel 50 may be replaced and is considered analogous to sphere type structure mounted to the legs 40. Conventional locking structures, not shown, may be employed to lock the wheels 50 such that they are not rotatably. Each of the legs 40 is telescopic and has an adjustable height. This may be achieved in a conventional manner such as by including a pair of sections 52, 54 wherein a second section 54 is extendable outwardly of a first section 52. The first 52 and second sections 54 are lockable at a selected height by a pin 56 extending from the first section 52 and removably engageable with one of a plurality of aligned apertures 58 in the second section 54. Each of the sets of legs 42, 44 includes three legs 40 comprising a central leg 60 and a pair of lateral legs 62. The central leg 60 is proximate to an associated one of the upper edges 16. Each of the first 20 and second 22 lateral edges has one of the lateral legs 62 positioned proximate thereto such that the central leg 60 is positioned between a pair of the lateral legs 62. The lateral legs 62 are each proximate to an associated one of the lower edges 18. The legs 40 are angled outwardly from the plates between 5° and 15° with respect to a vertically oriented plane.

Figure 6:
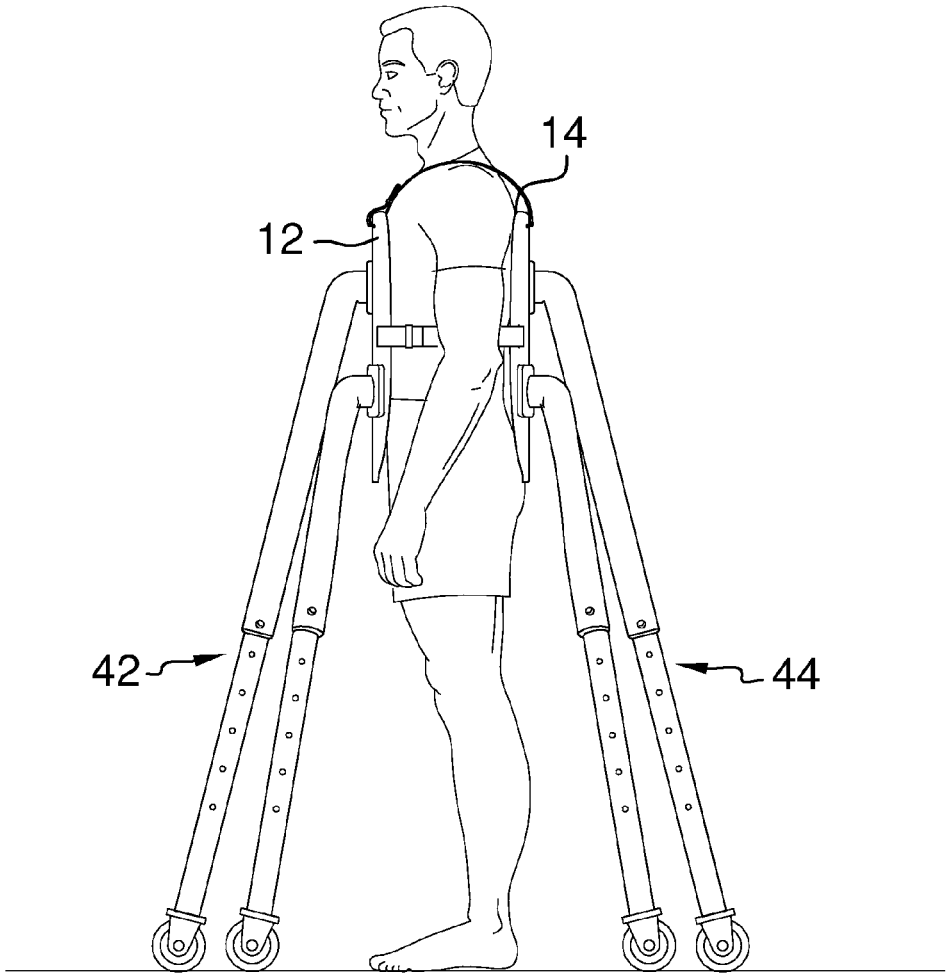
FIG. 6 is a side in-use view of an embodiment of the disclosure.

In use, the plates 12, 14 are positioned on opposite sides of a torso of a person as shown in FIG. 6. Once in place, the straps 28, 30 are tightened to hold the plates in secure abutment with the person such that the legs 40 extend downwardly from the person and engage a floor surface. The assembly 10, and more particularly the legs 40, will assist the person while they are walking to prevent their falling such as during rehabilitation after an injury.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A walking assist assembly configured to be attached to a torso of a person, said assembly comprising:

a pair of plates each having an upper edge, a lower edge, a first lateral ledge and a second lateral edge, said plates having an inner surface and an outer surface relative to each other such that said inner surfaces face each other;

a plurality of straps being attached to and extending between said pair of plates;

a plurality of legs defining a first set of legs and a second set of legs, said first set of said legs being attached to said outer surface of one of said plates and said second set of legs being attached to said outer surface of the other one of said plates, each of said legs including an upper end and a lower end, each of said lower ends terminating with a rotatable and swiveling wheel said plates nonrigidly interconnected to each other solely by said straps; and wherein said plates are configured to be positioned on opposite sides of a torso of a person such that said legs assist the person while walking.

2. The walking assist assembly according to claim 1, wherein each of said inner surfaces are concavely arcuate from said first lateral edge to said second lateral edge.

3. The walking assist assembly according to claim 1, wherein said plurality of straps includes a pair of upper straps extending between associated ones of said upper edges, said plurality of straps including a pair of lateral straps, one of said lateral straps extending between aligned ones of said first lateral edges and one of said lateral straps extending between aligned ones of said second lateral edges.

4. The walking assist assembly according to claim 1, wherein each of said legs is telescopic and has an adjustable height.

5. The walking assist assembly according to claim 1, wherein each of said sets of legs includes three legs comprising a central leg and a pair of lateral legs.

6. The walking assist assembly according to claim 5, wherein said central leg is proximate to an associated one of said upper edges, each of said first and second lateral edges having one of said lateral legs positioned proximate thereto, said lateral legs being proximate an associated one of said lower edges.

7. A walking assist assembly configured to be attached to a torso of a person, said assembly comprising:

a pair of plates each having an upper edge, a lower edge, a first lateral ledge and a second lateral edge, said plates having an inner surface and an outer surface relative to each other such that said inner surfaces face each other, each of said inner surfaces being concavely arcuate from said first lateral edge to said second lateral edge;

a plurality of straps being attached to and extending between said pair of plates, said plurality of straps including a pair of upper straps extending between associated ones of said upper edges, said plurality of straps including a pair of lateral straps, one of said lateral straps extending between aligned ones of said first lateral edges and one of said lateral straps extending between aligned ones of said second lateral edges;

a plurality of legs defining a first set of legs and a second set of legs, said first set of said legs being attached to said outer surface of one of said plates and said second set of legs being attached to said outer surface of the other one of said plates, each of said legs including an upper end and a lower end, each of said lower ends terminating with a rotatable and swiveling wheel, each of said legs being telescopic and having an adjustable height, each of said sets of legs including three legs comprising a central leg and a pair of lateral legs, said central leg being proximate to an associated one of said upper edges, each of said first and second lateral edges having one of said lateral legs positioned proximate thereto, said lateral legs being proximate an associated one of said lower edges; and wherein said plates are configured to be positioned on opposite sides of a torso of a person such that said legs assist the person while walking.

* * * * *